United States Patent [19]

Zimmer

[11] 4,077,321

[45] Mar. 7, 1978

[54] ADJUSTABLE MOUNT FOR ROTARY SCREEN

[76] Inventor: Johannes Zimmer, Ebentalerstrasse 133, A-9020 Klagenfurt, Austria

[21] Appl. No.: 726,258

[22] Filed: Sep. 24, 1976

[51] Int. Cl.[2] ..... B41F 15/38

[52] U.S. Cl. ..... 101/128.1

[58] Field of Search ..... 101/115, 116, 127.1, 101/128.1, 375, 376, 212, 248, 250, 286; 29/115, 116 R; 118/DIG. 15, 213, 406

[56] References Cited

U.S. PATENT DOCUMENTS

| | | | |
|---|---|---|---|
| 3,572,240 | 3/1971 | Bohm | 101/116 |
| 3,834,307 | 9/1974 | Zimmer | 101/127.1 X |
| 3,983,807 | 10/1976 | Mitter | 101/128.1 X |

FOREIGN PATENT DOCUMENTS

| | | | |
|---|---|---|---|
| 2,332,535 | 1/1974 | Germany | 101/127.1 |

*Primary Examiner*—Ronald E. Suter
*Attorney, Agent, or Firm*—Haseltine, Lake & Waters

[57] ABSTRACT

A screen station for a rotary screen-type printing machine including a frame for carrying a rotary screen; the screen has an axis, and the frame includes two struts disposed in parallel with the axis and carry four feet; the four support feet of the frame rest on a support; one foot pivotably supports the frame, and at least two of the feet are horizontally slidable with respect to the support or the struts.

13 Claims, 9 Drawing Figures

ADJUSTABLE MOUNT FOR ROTARY SCREEN

FIELD OF THE INVENTION

The present invention relates to a screen station for rotary screen type printing machines, where the rotary screens are carried by a frame having two struts disposed parallel with the axis of the screen, the frame resting by means of at least four feet on its support.

DESCRIPTION OF THE PRIOR ART

Until now it has been customary to effect angular orientation of the screen axis in a horizontal plane by adjustment of one of the mounting supports of the rotary screen in the longitudinal direction of the machine's frame (cf. U.S. Pat. No. 3,572,240).

This procedure does, however, have the disadvantage, that it is unavoidable to strain or stress the screen, although in a relatively small measure, which strain shortens the lifespan of the screen. The rotary screen is stressed due to the fact that the two mounting supports of the screen are displaced from the alignment position, in order to achieve the desired angular orientation of the screen.

OBJECT OF THE INVENTION

It is an object of the present invention to provide a device of the aforesaid type which makes it possible to alter the angular orientation of the screen axis in a horizontal plane without straining or stressing the screen.

SUMMARY OF THE INVENTION

It is therefore proposed, according to the invention, that the frame be pivotably supported about a foot referred to hereinafter as a pivot foot and that at least two additonal feed be horizontally displaceable on the support, or with respect to the associated struts, all the feet being, if necessary, adjustable in height.

Pivoting of the rigid frame about the pivot foot may be accomplished by any device engaging the frame. It has been found particularly favorable or advantageous to eccentrically support one of the feet carrying the frame for the pivoting of the latter. In order to take into account a change of distance between the eccentric foot and the pivot foot, which occurs upon pivoting the eccentric foot, one of the two feet must be displaceable along a line connecting the two feet.

The pivotable foot is preferably stationary with respect to the horizontal plane, whereby the choice remains to guide the eccentric foot in either a slit of the machine frame, or in a slit of the associated strut.

It is particularly advantageous if one strut of the frame is supported by both the pivot foot and the eccentric foot, the eccentric foot being guided in a slit formed in the machine frame and extending in the longitudinal direction of the strut. The latter arrangement permits an advantageous leverage to be obtained, and the slit guiding the eccentric foot may be tailored very precisely to the section of the eccentric foot gliding therein, which permits an almost playfree adjustment.

It is, however, also possible without any particular disadvantage, to arrange the pivot foot and the eccentric foot approximately along the diagonal of the frame. In order to avoid any jamming, it is, of course, necessary for the slit to be formed in the direction of the connecting lines between the pivot foot and the eccentric foot.

It is also possible to dispose both the pivot foot and the eccentric foot on a narrow side of the frame, but in this case the guidance slit of the eccentric foot must extend transversely to the longitudinal axis of the frame, which results in an unfavorable leverage.

It is a particular advantage of the arrangement that the pivot foot and the eccentric foot are on the same strut, that the transverse adjustment of the frame can be carried out in a simple manner. It is then only necessary to make the pivot foot displaceable in the longitudinal direction of the strut, the eccentric foot carrying the strut. Upon the longitudinal displacement of the strut with respect to the pivot foot, the eccentric foot moves in the slit provided for the latter's displacement for the purpose of angular adjustment. The two remaining feet of the frame then slide simply on the surface of their supports, or form a gliding support for all associated struts, just as in the case of the angular adjustment.

In a particularly advantageous embodiment of the eccentric foot, the latter surrounds a threaded spindle, which slides with a substantially cylindrical adapter disposed concentrically with the eccentric foot in a slit, and is supported or held in a eccentrically disposed threaded bore of a sleeve rotatably supported in the strut.

In this embodiment it is also possible to vary or adjust the height of the eccentric foot in a simple manner for the screen to properly abut the matter to be imprinted on, even if the remaining feet are adjustable in height. This measure additionally permits clamping different size screens onto the same frame, the screens having a predetermined range of diameters.

In order to avoid a simultaneous, but unintended height adjustment of the eccentric foot upon changing the angular orientation, it is proposed that the sleeve be formed with a slit extending in a direction of a diameter of the threaded bore, and that it be surrounded within the region of the slit by a resilient or springy ring, which compresses the region adjacent to the slit and thus increases the friction between the threaded spindle of the eccentric foot and the sleeve.

This results in a simultaneous turning of the threaded spindle of the eccentric foot, when the sleeve is rotated, and therefore no change in height adjustment results. It is, of course, also possible to provide arrangements for achieving appropriate friction between the sleeve and the strut, in order to avoid an unintended change of the angular orientation, but the friction between the sleeve and the strut should be smaller than the friction between the sleeve and the threaded spindle, since the position of the screen in a transverse direction with respect to the machine's frame (i.e., parallel to its own axis) may have to be additionally regulated or controlled under certain circumstances during the printing process, but where the height adjustment does not have to be so regulated.

It is particularly advantageous if the struts forming the frame are merely slipped on the feet, or are supported on the latter due to their own weight. When replacing the rotary screens, the frame is merely lifted together with the screen, while the feet remain on the support. Not only are few supporting feet required in this manner, but a damage of the feet is also avoided during shutdown of the screens.

BRIEF DESCRIPTION OF THE DRAWINGS

The invention is further illustrated with reference to the drawing, in which.

DESCRIPTION OF THE PREFERRED EMBODIMENTS

Figure 1:
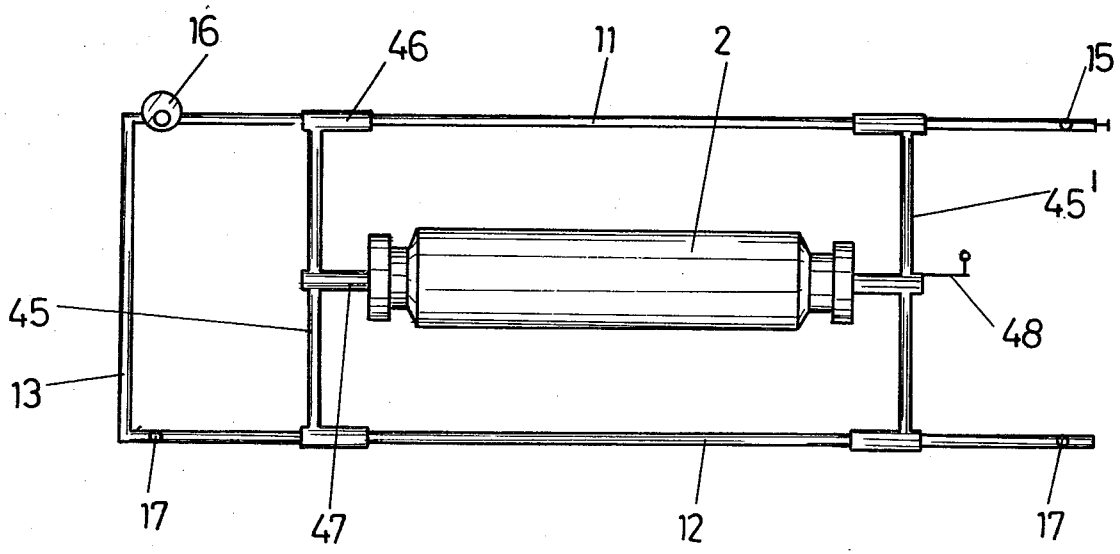
FIG. 1 shows a schematic plan view of the frame.

The frame consists substantially of two struts 11 and 12 which are joined to one another by a cross-beam or strut 13. Guidance members or portions 46 of a displaceable cross-beam 45 slide on struts 11 and 12, the cross-beam 45 having a center projection 47 engaging an end ring of the rotary screen 2. An additional cross-beam 45' is rigidly disposed on the struts 12 and 11, the rotary screen 2 being clamped with respect thereto by means of a clamping lever 48.

Figure 3:
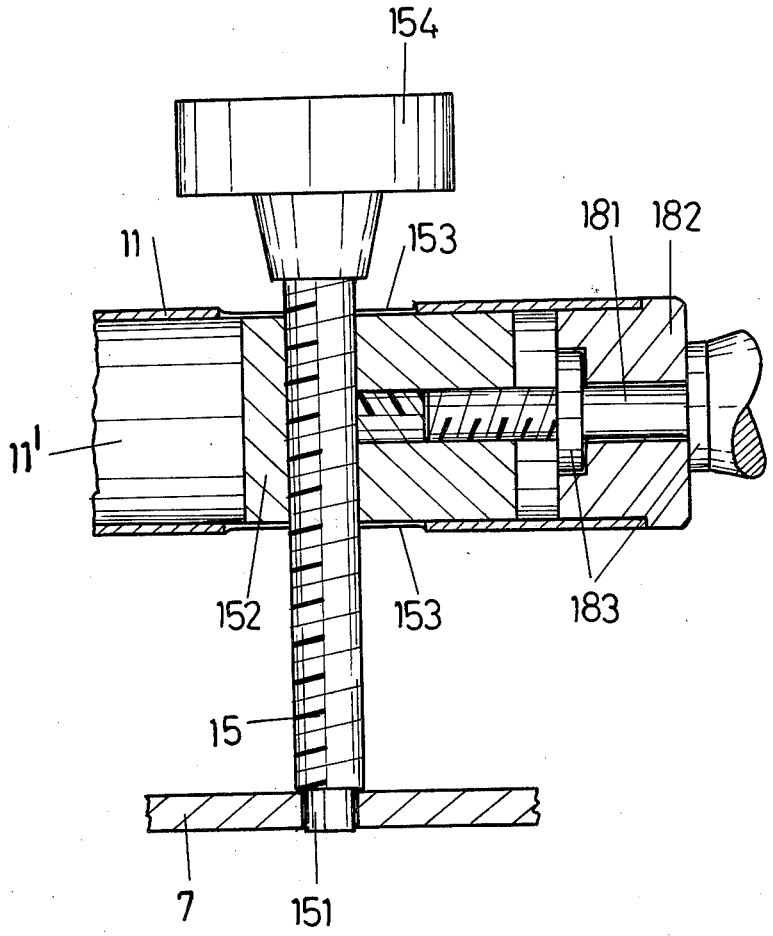
FIG. 3 shows a cross-section of the pivot foot of the first embodiment.

The pivot foot 15 shown schematically in FIG. 1 is supported on a part of the machine, for example, on the machine frame 7, or on a carriage of the rotary screen, as can best be seen in FIG. 3; the strut 11 is additionally abutting the eccentric foot 16, whereas the strut 12 abuts two feet 17 slightly displaceable with respect to the support.

Figure 2:
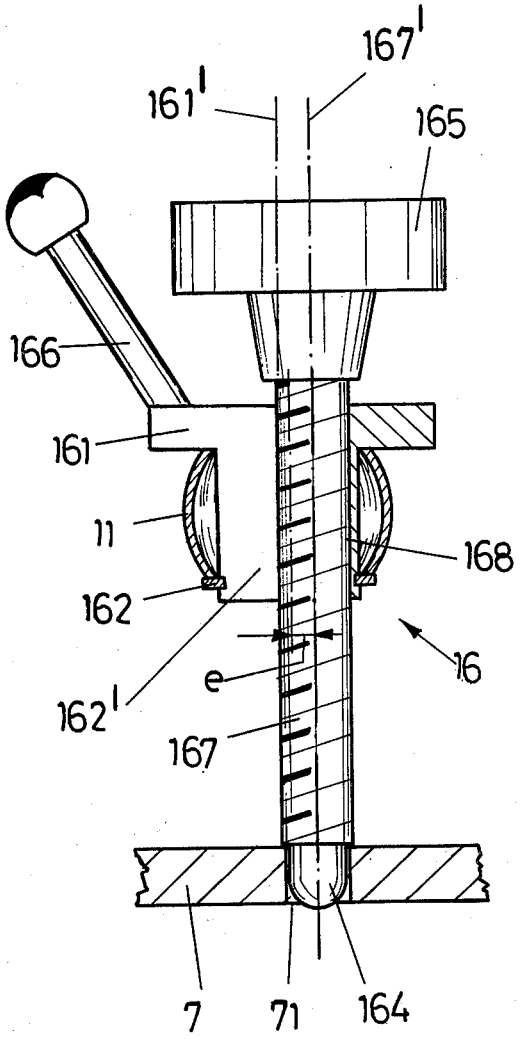
FIG. 2 shows a cross-section of the eccentric foot in a first embodiment.

The eccentric foot 16 is guided in a slit 71, best seen in FIG. 2, which extends in the longitudinal direction of the strut 11, i.e., generally in the direction of the connecting line of the pivot foot 15 and the eccentric foot 16. A substantially cylindrical adapter 164 engages the slit 71 formed in the machine frame 7, the adapter 164 being concentric with a threaded spindle 167, and having a smaller diameter than the threaded spindle 167. Very little play exists between the adapter 164 and the walls of the slit 71.

The threaded spindle 167 is rigid with a handle 165 and rotatable therewith about an axis 167', and passes through an eccentrically disposed threaded bore 168 of a sleeve 161 rotatably disposed about an axis 161' in the strut 11, the sleeve 161 being provided with a handle 166.

In order to increase the friction between the sleeve 161, or the threaded bore 168 of the sleeve, and the threaded spindle 167, over the friction existing between the sleeve 161 and the strut 11, the sleeve 161 is formed with a slot 162' along a diameter of the threaded bore 168, the slot being compressed by a resilient ring 162, for example, a seeger or circlip-lock ring, so that the threads of the threaded spindle and the threaded bore are pressed towards one another, the resilient ring 162 also determining the position of the sleeve in the vertical direction.

If now the handwheel 165 is turned, and the handle 166 is simultaneously held, then the distance between the machine frame 7 and the strut 11 changes, since the threaded spindle 167 is screwed more or less into the sleeve.

Adjustment of the angular orientation of the screen is accomplished by turning the sleeve 161 with the aid of the handle 166, so that the frame and the pivotable foot 15 is articulated. During the pivoting of the sleeve about the axis of the threaded spindle 167, the adapter 164 slides in the slit 71.

The eccentric disposition of the threaded bore 168 causes the strut 11 to be pivoted by the measure of that eccentricity "*e*" towards both sides of the axis of the threaded bore 167, which causes the whole frame, and therefore also the rotary screen to be pivoted. Since the screen is maintained in the frame, the pivoting of the frame does not result in the screen being stressed in any manner.

FIG. 3 shows one form of the support of the pivotable foot 15, permitting a simple adjustment of the screen in the direction of its axis. The pivotable foot 15, which is rotatably supported at its lower end 151 in the machine frame 7, but it otherwise fixed thereto, passes through a sliding member 152 which is longitudinally displaceable within a recess 11' of the strut 11 within the region of longitudinal slits 153. The sliding member 152 is displaceable in the longitudinal direction of the strut 11 by a lead screw 181, the lead screw 181 having two projections 183, which are slidable along an end member 182 closing off the strut 11. The strut 11 is height-adjustable with respect to the pivotable foot 15 by turning of the handle 154, since the sliding member 152 is formed with a thread for pivotable foot 15.

Figure 4:
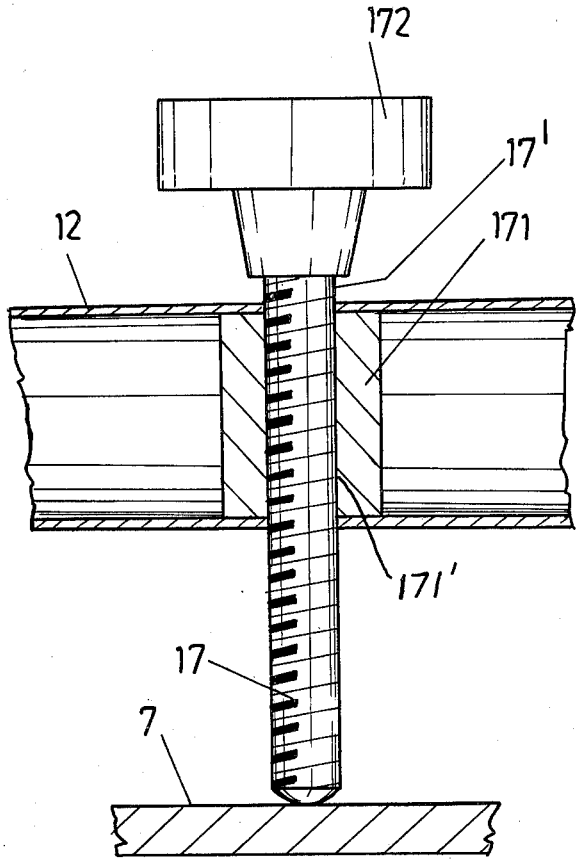
FIG. 4 shows a cross-section of one of the freely abutting feet.

The feet 17 shown in FIG. 4, which merely slide on their flat support 7 during longitudinal and transverse adjustments of the frame carrying the screen, are constructed in a very simple manner. They are merely formed with an outer thread 17' serving for height adjustment by means of the handwheel 172 and engage an inner thread 171' formed within an insert member 171 of the strut 12.

Figure 5:
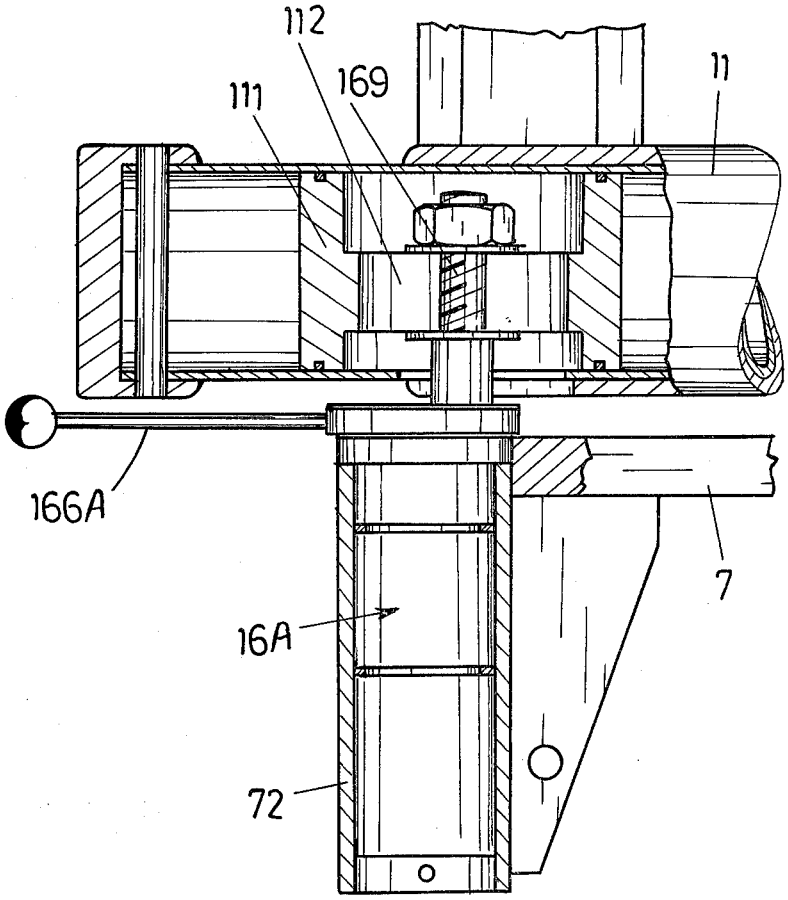
FIG. 5 shows a cross-section of the eccentric foot of another embodiment.
Figure 6:
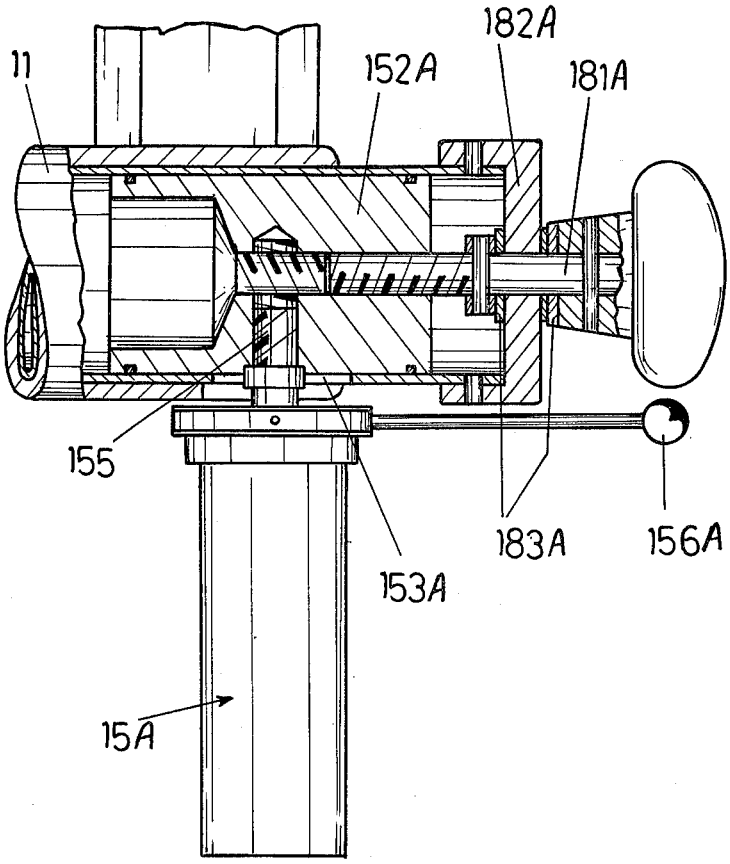
FIG. 6 is a cross-section of the corresponding pivot foot thereof.

The embodiment according to FIGS. 5 and 6, corresponds substantially to those of FIGS. 2 and 3. The eccentric foot 16A shown in FIG. 5 is not, however, displaceable in the longitudinal slit on is own, but carries an eccentric bolt 169 which slides in a longitudinal slit 112 in an insert 111 of the strut 11, if the eccentric foot 16A is rotated by means of the handle 166A in a collar 72 disposed below the surface of the frame 7, so that the whole frame is pivoted thereby.

The transverse alignment of the pivot foot 15A shown in FIG. 6 is accomplished in the same manner as that shown in FIG. 3. The pivoting is not, however, accomplished here by a rotation of the foot 15A, but by rotation of the frame about a projection 155 projecting through a slit 153A into threaded engagement in sliding member 152A in the strut 11. This projection is disposed eccentrically for the case shown, and is pivotable about the axis of the pivot foot 15A by means of a handle 156A, so that a parallel displacement of the frame in the direction of the web is possible. As in the embodiment in FIG. 3, the sliding member 152A receives a lead screw 181A with two projections 183A on opposite sides of end member 181A. Hence, when shaft 181A is turned, sliding member 152A will undergo sliding movement in strut 11.

Figure 7A:
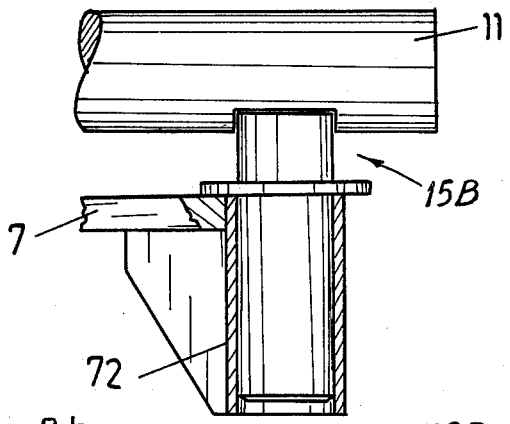
FIGS. 7*a*–7*c* show an embodiment of struts liftable by the feet.
Figure 7B:
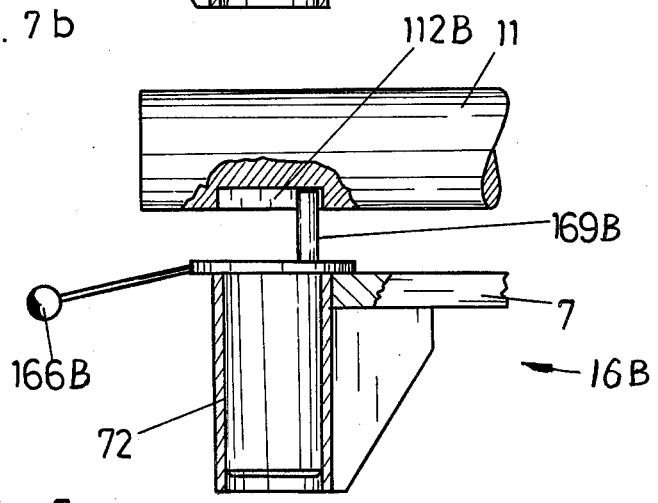
Figure 7C:
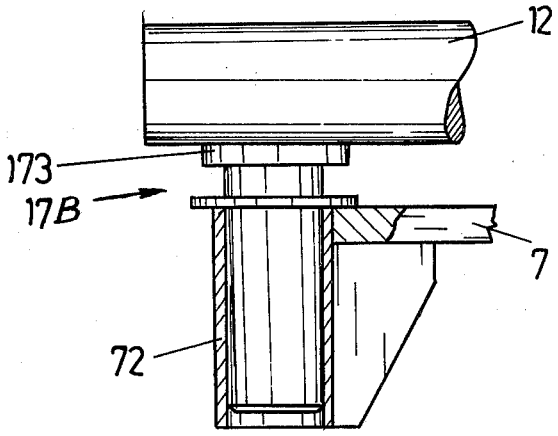

It is a particular advantage of the present invention that the whole frame carrying the screen may easily be lifted by two workers and inserted into the machine when the screens are replaced. This is particularly easily carried out if the feet remain slipped onto the machine frame, and the struts are lifted therefrom during this manipulation. A corresponding implementation is shown in FIGS. 7*a* through 7*c* where similar reference numerals denote corresponding structure in earlier embodiments. A pivot foot 15B is shown in FIG. 7*a*, the strut 11 being rotatable thereabout; FIG. 7*b* shows an eccentric foot 16B with a bolt 169B, which slides in a slit 112B formed on the underside of the strut 11, and FIG. 7*c* shows one of the feet 17B, on whose upper platform 173 the strut 12 glides during a change of the screen's position or orientation.

It should be emphasized again that the present invention is not limited to rotary-screen printing machines, where the printing stations are stationary and the material to be printed is passed through underneath the rotary screens on a printer's blanket. That part of the machine in which the frame carrying the screen is positioned, may as well be a carriage which is moved in a manner known per se along the material to be printed which is stationary during the printing process. During the magnetic contact pressure of the squeegee arrangement, this carriage may be embodied by a bar-shaped magnet element which is mounted on rollers and causes the magnetic contact pressure.

What is claimed is:

1. A screen station for a rotary screen-type printing machine comprising: a frame for carrying a rotary screen, said screen having an axis, said frame including two struts disposed parallel to said axis, and four feet mounted on said struts abuttable against a support and supporting said frame, a first of said feet including means for pivotably supporting said frame, and means providing relative horizontal slidable movement between said first foot and a second foot with respect to the support or a respective one of said struts said other two feet being movable relative to said support or a respective one of said struts.

2. A screen station according to claim 1 wherein said feet are formed with respective outer threads, and further comprising a member insertable into each of said struts, said member being formed with an inner thread, said outer threads being engageable with said inner threads, respectively, for a height adjustment of said struts.

3. A screen station according to claim 1 wherein said second foot includes means for laterally displacing said frame relative to said support.

4. A screen station according to claim 3 wherein said means of said second foot comprises a threaded spindle, an eccentric sleeve surrounding said spindle, the support being formed with a slit, a substantially cylindrical adapter disposed concentrically with said spindle and slidable in said slit, said sleeve being rotatably disposed in one of said struts and formed with an eccentric threaded bore, said threaded spindle engaging said threaded bore.

5. A screen station according to claim 4, wherein said sleeve is provided with a slot extending in the direction of a diameter of said threaded bore and further comprising a resilient ring surrounding said sleeve within the region of said slot for increasing the friction between said threaded spindle, and said sleeve.

6. A screen station according to claim 3, further comprising two collars disposed below the frame for supporting said first and second feet, respectively.

7. A screen station according to claim 3, wherein one of said struts is formed with a first recess, said second foot being partly disposed in said first recess, and means for relatively displacing said second foot and said one strut in the longitudinal direction of said one strut.

8. A screen station according to claim 7 further comprising a member attached to said one of said struts and disposed within said first recess, and connecting means disposed between said member and said second foot for changing the length of the connection between said one strut and said support.

9. A screen station according to claim 8 wherein said member is provided with a transverse threaded bore and said second foot has a thread engageable with said transverse bore and passing at least partially therethrough, said member being longitudinally slidable within said one of said struts, and being provided with an axial threaded bore, and further comprising a lead screw having two projections and engageable with said axial threaded bore, and an end member secured to said one strut and closing off said first recess, said projections being slidable on said end member.

10. A screen station according to claim 3 wherein said first and second feet support one of said struts and the remaining two feet support the other strut.

11. A screen station according to claim 3, wherein said means of said second foot comprises a main foot portion pivotably supported in said support and an eccentric foot portion pivotally supported in the frame, said eccentric foot portion and main foot portion having offset axes, such that rotation of one of said portions produces said lateral displacement of said frame.

12. A screen station according to claim 11 wherein said eccentric foot portion is disposed in one of said struts, said one of said struts being provided with a longitudinal slit, and further comprising an eccentric bolt disposed in said longitudinal slit and attached to said eccentric foot portion for guiding the latter within said longitudinal slit.

13. A screen station according to claim 3, wherein said support has a slot therein, one of said first and second feet being slidably mounted in said slot, said slot extending along a line joining said first and second feet.

* * * * *